US006312883B1

(12) United States Patent
Parton et al.

(10) Patent No.: US 6,312,883 B1
(45) **Date of Patent: *Nov. 6, 2001**

(54) PHOTOGRAPHIC MATERIAL HAVING ENHANCED LIGHT ABSORPTION AND LOW DYE STAIN

(75) Inventors: Richard L. Parton, Webster; Thomas L. Penner, Fairport; Stephen A. Hershey, Victor, all of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/599,468

(22) Filed: Jun. 22, 2000

(51) Int. Cl.[7] ..... G03C 1/08; G03C 1/29

(52) U.S. Cl. ..... 430/574; 430/572; 430/577; 430/583; 430/584

(58) Field of Search ..... 430/572, 570, 430/574, 583, 584, 585, 577, 580

(56) References Cited

U.S. PATENT DOCUMENTS

| | | | | |
|---|---|---|---|---|
| 2,518,731 | | 8/1950 | Thompson . | |
| 3,622,316 | | 11/1971 | Bird et al. . | |
| 3,976,493 | | 8/1976 | Borror et al. . | |
| 3,976,640 | | 8/1976 | Borror et al. . | |
| 4,040,825 | | 8/1977 | Steiger et al. . | |
| 4,138,551 | | 2/1979 | Steiger et al. . | |
| 4,950,587 | | 8/1990 | Roberts et al. . | |
| 5,055,387 | * | 10/1991 | Diehl et al. | 430/591 |
| 6,117,629 | * | 9/2000 | Yamashita et al. | 430/570 |

FOREIGN PATENT DOCUMENTS

| | | |
|---|---|---|
| 0 270 079 | 6/1988 | (EP) . |
| 0 270 082 | 6/1988 | (EP) . |
| 0 565 074 | 10/1993 | (EP) . |
| 0 838 719 | 4/1998 | (EP) . |
| 64-91134 | 10/1989 | (JP) . |
| 10-171058 | 6/1998 | (JP) . |

OTHER PUBLICATIONS

Steiger et al. Photographic Science & Engineering, 1983, vol. 27, No. 2, pp. 59–65.

Penner et al., Photographic Science & Engineering, 1976, vol. 20, No. 3, pp. 97–106.

Penner, Photographic Science & Engineering, 1977, vol. 21, No. 1, pp. 32–36.

Bird, Photographic Science & Engineering, 1974, vol. 18, No. 5, pp. 562–568.

Forster, Disc. Faraday Soc., Laboratory of Physical Chemistry, Technische Hochshule, Stuttgart, 10th Spiers Memorial Lecture, "Transfer Mechanisms of Electronic Excitation", Apr. 14, 1959.

* cited by examiner

*Primary Examiner*—Thorl Chea
(74) *Attorney, Agent, or Firm*—Edith A. Rice

(57) ABSTRACT

A silver halide photographic material comprises at least one silver halide emulsion comprising silver halide grains having associated therewith at least two dyes:

(a) a first dye that has at least one anionic substituent and that is capable of spectrally sensitizing a silver halide emulsion; and (b) a second dye of formula II

II wherein:

$R^1$ is a substituted or unsubstituted alkyl or aryl group;

$E^3$ represents the atoms necessary to complete a substituted or unsubstituted 5- or 6-membered heterocyclic nucleus;

$Ar^1$ represents an electron-withdrawing substituted aryl, or a substituted or unsubstituted electron-withdrawing heteroaryl group;

$L^{11}$ through $L^{14}$ are substituted or unsubstituted methine groups;

s is 0 or 1;

$G^1$ is an electron-withdrawing group;

$G^2$ is O or dicyanovinyl ($C(CN)_2$);

$W^1$ is a counterion if necessary.

17 Claims, No Drawings

PHOTOGRAPHIC MATERIAL HAVING ENHANCED LIGHT ABSORPTION AND LOW DYE STAIN

FIELD OF THE INVENTION

This invention relates to a silver halide photographic material containing at least one silver halide emulsion that has enhanced light absorption and low dye stain.

BACKGROUND OF THE INVENTION

J-aggregating cyanine dyes are used in many photographic systems. It is believed that these dyes adsorb to a silver halide emulsion and pack together on their "edge" which allows the maximum number of dye molecules to be placed on the surface. However, a monolayer of dye, even one with as high an extinction coefficient as a J-aggregated cyanine dye, absorbs only a small fraction of the light impinging on it per unit area. The advent of tabular emulsions allowed more dye to be put on the grains due to increased surface area. However, in most photographic systems, it is still the case that not all the available light is being collected.

The need is especially great in the blue spectral region where a combination of low source intensity and relatively low dye extinction result in deficient photoresponse. The need for increased light absorption is also great in the green sensitization of the magenta layer of color negative photographic elements. The eye is most sensitive to the magenta image dye and this layer has the largest impact on color reproduction. Higher speed in this layer can be used to obtain improved color and image quality characteristics. The cyan layer could also benefit from increased red-light absorption which could allow the use of smaller emulsions with less radiation sensitivity and improved color and image quality characteristics. For certain applications, it may be useful to enhance infrared light absorption in infrared sensitized photographic elements to achieve greater sensitivity and image quality characteristics.

One way to achieve greater light absorption is to increase the amount of spectral sensitizing dye associated with the individual grains beyond monolayer coverage of dye (some proposed approaches are described in the literature, G. R. Bird, *Photogr. Sci. Eng.,* 18, 562 (1974)). One method is to synthesize molecules in which two dye chromophores are covalently connected by a linking group (see U.S. Pat. Nos. 2,518,731, 3,976,493, 3,976,640, 3,622,316, Kokai Sho 64(1989)91134, and EP 565,074). This approach suffers from the fact that when the two dyes are connected they can interfere with each other's performance, e.g., not aggregating on or adsorbing to the silver halide grain properly.

In a similar approach, several dye polymers were synthesized in which cyanine dyes were tethered to poly-L-lysine (U.S. Pat. No. 4,950,587). These polymers could be combined with a silver halide emulsion, however, they tended to sensitize poorly and dye stain (an unwanted increase in D-min due to retained sensitizing dye after processing) was severe in this system and unacceptable.

A different strategy involves the use of two dyes that are not connected to one another. In this approach the dyes can be added sequentially and are less likely to interfere with one another. Miyasaka et al. in EP 270 079 and EP 270 082 describe silver halide photographic material having an emulsion spectrally sensitized with an adsorbable sensitizing dye used in combination with a non-adsorbable luminescent dye which is located in the gelatin phase of the element. Steiger et al. in U.S. Pat. Nos. 4,040,825 and 4,138,551 describe silver halide photographic material having an emulsion spectrally sensitized with an adsorbable sensitizing dye used in combination with second dye which is bonded to gelatin. The problem with these approaches is that unless the dye not adsorbed to the grain is in close proximity to the dye adsorbed on the grain (less than 50 angstroms separation) efficient energy transfer will not occur (see T. Förster, *Disc. Faraday Soc.,* 27 (1959)). Most dye off-the-grain in these systems will not be close enough to the silver halide grain for energy transfer, but will instead absorb light and act as a filter dye leading to a speed loss. A good analysis of the problem with this approach is given by Steiger et al. (*Photogr. Sci. Eng.,* 27, 59 (1983)).

A more useful method is to have two or more dyes form layers on he silver halide grain. Penner and Gilman described the occurrence of greater than monolayer levels of cyanine dye on emulsion grains, *Photogr. Sci. Eng.,* 20, 97 (1976); see also Penner, *Photogr. Sci. Eng.,* 21, 32 (1977). In these cases, the outer dye layer absorbed light at a longer wavelength than the inner dye layer (the layer adsorbed to the silver halide grain). Bird et al. in U.S. Pat. No. 3,622,316 describe a similar system. A requirement was that the outer dye layer absorb light at a shorter wavelength than the inner layer. This appears to be the closest prior art to our invention. The problem with previous dye layering approaches was that the dye layers described produced a very broad sensitization envelope. This would lead to poor color reproduction since, for example, the silver halide grains in the same color record would be sensitive to both green and red light.

Yamashita et. al. (EP 838 719 A2) describes the use of two or more cyanine dyes to form more than one dye layer on silver halide emulsions. The dyes are required to have at least one aromatic or heteroaromatic substituent attached to the chromophore via the nitrogen atoms of the dye. Yamashita et. al. teaches that dye layering will not occur if this requirement is not met. This is undesirable because such substitutents can lead to large amounts of retained dye after processing (dye stain) which affords increased D-min. We have found that this is not necessary and that neither dye is required to have a at least one aromatic or heteroaromatic substitute attached to the chromophore via the nitrogen atoms of the dye.

Further improvements in dye layering have been described in U.S. application Ser. No. 09/151,974 filed Sep. 11, 1998, U.S. application Ser. No. 09/151,915 filed Sep. 11, 1998, U.S. application Ser. No. 09/151,916 filed Sep. 11, 1998, and U.S. application Ser. No. 09/151,977 filed Sep. 11, 1998. For certain photographic applications it is highly desirable that the dyes used for dye layering at least partially bleach, that is decolorize, during the processing of the photographic element. Retained dye can contribute to Dmin and is often very undesirable. However, even though some of the dyes described in the applications cited above afford reduced dye stain further improvements are needed.

PROBLEM TO BE SOLVED BY THE INVENTION

Not all the available light is being collected in many photographic systems. The need is especially great in the blue spectral region where a combination of low source intensity and relatively low dye extinction result in deficient photoresponse. The need for increased light absorption is also great in the green sensitization of the magenta layer of color negative photographic elements. The eye is most sensitive to the magenta image dye and this layer has the largest impact on color reproduction. Higher speed in this layer can be used to obtain improved color and image quality characteristics. The cyan layer could also benefit from increased red-light absorption which could allow the use of smaller emulsions with less radiation sensitivity and improved color and image quality characteristics. For certain applications, it may be useful to enhance infrared light absorption in infrared sensitized photographic elements to achieve greater sensitivity and image quality characteristics.

The use of more than one dye layer to enhance light absorption is often accompanied by much higher levels of post-process retained dye (dye stain). It would be highly desirable if dyes could be found that bleach (decolorize) during processing providing lower dye stain. The dyes of this invention have enhanced bleaching rates affording less post-process dye stain.

SUMMARY OF THE INVENTION

We have found that it is possible to form more than one dye layer on silver halide emulsion grains and that this can afford increased light absorption and that the invention dyes give lower levels of dye stain. The dye layers are held together by a non-covalent attractive force such as electrostatic bonding, van der Waals interactions, hydrogen bonding, hydrophobic interactions, dipole-dipole interactions, dipole-induced dipole interactions, London dispersion forces, cation-$\pi$interactions, etc. or by in situ bond formation. The inner dye layer(s) is absorbed to the silver halide grains and contains at least one spectral sensitizer. The outer dye layer(s) (also referred to herein as an antenna dye layer(s)) absorbs light at an equal or higher energy (equal or shorter wavelength) than the adjacent inner dye layer(s). The light energy emission wavelength of the outer dye layer overlaps with the light energy absorption wavelength of the adjacent inner dye layer.

We have also found that silver halide grains sensitized with at least one dye containing at least one anionic substituent and at least one dye containing at least one cationic substituent provides increased light absorption.

One aspect of this invention comprises a silver halide photographic material comprising at least one silver halide emulsion comprising silver halide grains having associated therewith at least two dye layers comprising (a) an inner dye layer adjacent to the silver halide grain and comprising at least one dye, Dye 1, that is capable of spectrally sensitizing silver halide and (b) an outer dye layer adjacent to the inner dye layer and comprising at least one dye, Dye 2, wherein Dye 2 is merocyanine dye and wherein the dye layers are held together by non-covalent forces; the outer dye layer adsorbs light at equal or higher energy than the inner dye layer; and the energy emission wavelength of the outer dye layer overlaps with the energy absorption wavelength of the inner dye layer.

In one preferred embodiment of the invention the silver halide emulsion is dyed with a saturation or near saturation monolayer of one or more cyanine dyes which have either a positive or negative net charge or the net charge can be zero if one of the substitutents has a negative charge. The area a dye covers on the silver halide surface can be determined by preparing a dye concentration series and choosing the dye level for optimum performance or by well-known techniques such as dye adsorption isotherms (for example see W. West, B. H. Carroll, and D. H. Whitcomb, J. Phys. Chem, 56, 1054 (1962)). The second layer consists of antenna dyes which have a net charge of opposite sign compared to the dyes of the first layer.

In one preferred embodiment the dye or dyes that have at least one anionic substituent and that are capable of spectrally sensitizing a silver halide emulsion are present at a concentration of at least 80% of monolayer coverage and the antenna dye or dyes are present in an amount of at least 50% or monolayer coverage.

In another preferred embodiment, the dye or dyes of the outer dye layer and the dye or dyes of the inner dye layer have their maximum light absorption either between 400 to 500 nm or between 500 to 600 nm or between 600 and 700 nm or between 700 and 1100 nm.

Another aspect of this invention comprises a silver halide photographic material comprising at least one silver halide emulsion comprising silver halide grains having associated therewith at least one dye which is capable of spectrally sensitizing a silver halide emulsion and having at least one anionic substituent. Also present is at least one merocyanine dye having at least one cationic substituent.

The antenna dyes of this invention have an electron-withdrawing substituent. The dyes decolorize more rapidly than the comparison dyes and afford reduced post-process dye stain.

ADVANTAGEOUS EFFECT OF THE INVENTION

The invention provides increased light absorption and photographic sensitivity by forming more than one layer of sensitizing dye on silver halide grains. The dyes of the invention give lower levels of dye stain. The increased sensitivity could be used to improve granularity by using smaller emulsions and compensating the loss in speed due to the smaller emulsions by the increased light absorption of the dye layers of the invention. In addition to improved granularity, the smaller emulsions would have lower ionizing radiation sensitivity. Radiation sensitivity is determined by the mass of silver halide per grain. The invention also provides good color reproduction, i.e., no excessive unwanted absorptions in a different color record. Further, the amount of retained dye after processing is minimized by using dyes that decolorize readily during processing of the photographic element. This invention achieves these features whereas methods described in the prior art can not.

DETAILED DESCRIPTION OF THE INVENTION

As mentioned above, in preferred embodiments of the invention silver halide grains have associated therewith dyes layers that are held together by non-covalent attractive forces. Examples of non-covalent attractive forces include electrostatic attraction, hydrogen-bonding, hydrophobic, and van der Waals interactions or any combinations of these. In addition, in situ bond formation between complimentary chemical groups would be valuable for this invention. For example, one layer of dye containing at least one boronic acid substituent could be formed. Addition of second dye having at least one diol subsitutent could result in the formation of two dye layers by the in situ formation of boron-diol bonds between the dyes of the two layers. Another example of in situ bond formation would be the formation of a metal complex between dyes that are adsorbed to silver halide and dyes that can form a second or subsequent layer. For example, zirconium could be useful for binding dyes with phosphonate substitutents into dye layers. For a non-silver halide example see H. E. Katz et. al., Science, 254, 1485, (1991).

In a preferred embodiment the current invention uses a combination of a cyanine dye capable of spectral sensitizing a silver halide emulsion with at least one anionic substituent and a second dye, preferably a merocyanine dye, with at least one cationic substituent. In another preferred embodiment the second dye with at least one cationic substituent is a merocyanine having a electron-withdrawing substituent. The merocyanine dye at least partially decolorizes during processing to decrease dye stain.

In order to realize the maximal light capture per unit area of silver halide, it is preferred that the dye or dyes of the outer dye layer (also referred to herein as antenna dye(s)), plus any additional dye layers in a multilayer deposition, also be present in a J-aggregated state. For the preferred dyes, the J-aggregated state affords both the highest extinction coefficient and fluorescence yield per unit concentration of dye. Furthermore, extensively J-aggregated secondary cationic dye layers are practically more robust, particularly with respect to desorption and delayering by anionic surfactant-stabilized color coupler dispersions. In addition, when the preferred dyes are layered above a conventional cyanine sensitizing dye of opposite charge which is adsorbed directly to the silver halide surface, the inherent structural dissimilarity of the two dye classes minimizes co-adsorption and dye mixing (e.g., cyanine dye plus merocyanine dye) on the grain. Uncontrolled surface co-aggregation between dyes of opposite charge (e.g. anionic cyanine plus cationic cyanine) can result in a variety of undesirable photographic effects, such as severe desensitization.

In one preferred embodiment, the antenna dye layer can form a well-ordered liquid-crystalline phase (a lyotropic mesophase) in aqueous media (e.g. water, aqueous gelatin, methanolic aqueous gelatin etc.), and preferably forms a smectic liquid-crystalline phase (W. J. Harrison, D. L. Mateer & G. J. T. Tiddy, *J.Phys.Chem.* 1996, 100, pp 2310–2321). More specifically, in one embodiment preferred antenna dyes will form liquid-crystalline J-aggregates in aqueous-based media (in the absence of silver halide grains) at any equivalent molar concentration equal to, or 4 orders of magnitude greater than, but more preferably at any equivalent molar concentration equal to or less than, the optimum level of primary silver halide-adsorbed dye deployed for conventional sensitization (see *The Theory of the Photographic Process,* $4^{th}$ edition, T. H. James, editor, Macmillan Publishing Co., New York, 1977, for a discussion of aggregation).

Mesophase-forming dyes may be readily identified by someone skilled in the art using polarized-light optical microscopy as described by N. H. Hartshorne in *The Microscopy of Liquid Crystals,* Microscope Publications Ltd., London, 1974. In one embodiment, preferred antenna dyes when dispersed in the aqueous medium of choice (including water, aqueous gelatin, aqueous methanol etc. with or without dissolved electrolytes, buffers, surfactants and other common sensitization addenda) at optimum concentration and temperature and viewed in polarized light as thin films sandwiched between a glass microscope slide and cover slip display the birefingence textures, patterns and flow rheology characteristic of distinct and readily identifiable structural types of mesophase (e.g. smectic, nematic, hexagonal). Furthermore, in one embodiment, the preferred dyes when dispersed in the aqueous medium as a liquid-crystalline phase generally exhibit J-aggregation resulting in a unique bathochromically shifted spectral absorption band yielding high fluorescence intensity. In another embodiment useful hypsochromically shifted spectral absorption bands may also result from the stabilization of a liquid-crystalline phase of certain other preferred dyes. In certain other embodiments of dye layering, especially in the case of dye layering via in situ bond formation, it may be desirable to use antenna dyes that do not aggregate.

In another preferred embodiment the second layer comprises a mixture of merocyanine dyes. Wherein at least one merocyanine has a cationic substituent and at least one merocyanine dye has an anionic substituent. Merocyanine dyes with anionic substituents are well know in the literature (see Hamer, *Cyanine Dyes and Related Compounds,* 1964 (publisher John Wiley & Sons, New York, N.Y.)). Merocyanine dyes with cationic substituents have been described in U.S. Pat. No. 4,028,353.

In a preferred embodiment, the first dye layer comprises one or more cyanine dyes. Preferably the cyanine dyes have at least one negatively charged substituent. In another preferred embodiment, the second dye layer comprises one or more merocyanine dyes. Preferably the merocyanine dyes have at least one positively charged substituent. In another preferred embodiment the second dye layer consists of a mixture of merocyanine dyes that have at least one positively charged substituent and merocyanine dyes that have at least one negatively charged substituent.

The dye or dyes of the first layer are added at a level such that, along with any other adsorbants (e.g., antifogants), they will substantially cover at least 80% and more preferably 90% of the surface of the silver halide grain. The area a dye covers on the silver halide surface can be determined preparing a dye concentration series and choosing the dye level for optimum performance or by well-known techniques such as dye adsorption isotherms (for example see W. West, B. H. Carroll, and D. H. Whitcomb, J. Phys. Chem, 56, 1054 (1962)).

For green light absorbing dyes a preferred embodiment is that at least one dye of the first layer contain a benzoxazole nucleus. The benzoxazole nucleus is preferably independently substituted with an aromatic substituent, such as a phenyl group, a pyrrole group, etc.

In some cases, during dye addition and sensitization of the silver halide emulsion, it appears that excess gelatin can interfere with the dye layer formation. In some cases, it is preferred to keep the gelatin levels below 8% and preferably below 4% by weight. Additional gelatin can be added after the dye layers have formed.

In describing preferred embodiments of the invention, one dye layer is described as an inner layer and one dye layer is described as an outer layer. It is to be understood that one or more intermediate dye layers may be present between the inner and outer dye layers, in which all of the layers are held together by non-covalent forces, as discussed in more detail above. Further, the dye layers need not completely encompass the silver halide grains of underlying dye layer(s). Also some mixing of the dyes between layers is possible.

The dyes of the first dye layer are any dyes capable of spectrally sensitizing a silver halide emulsion, for example, a cyanine dye, merocyanine dye, complex cyanine dye, complex merocyanine dye, homopolar cyanine dye,or hemicyanine dye, etc. Of these dyes, merocyanine dyes containing a thiocarbonyl group and cyanine dyes are particularly useful. Of these, cyanine dyes are especially useful. Particularly preferred as dyes for the first layer are cyanine dyes of Formula Ia or merocyanine dyes of Formula Ib.

(Ia)

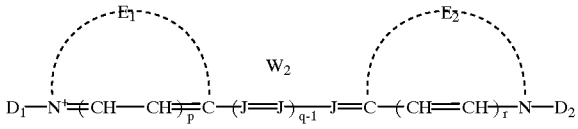

wherein:

$E_1$ and $E_2$ may be the same or different and represent the atoms necessary to form a substituted or unsubstituted heterocyclic ring which is a basic nucleus (see *The Theory of the Photographic Process,* 4th edition, T. H. James, editor, Macmillan Publishing Co., New York, 1977 for a definition of basic and acidic nucleus), each J independently represents a substituted or unsubstituted methine group, q is a positive integer of from 1 to 4, q and r each independently represents 0 or 1, $D_1$ and $D_2$ each independently represents substituted or unsubstituted alkyl or unsubstituted aryl and at least one of $D_1$ and $D_2$ contains an anionic substituent, $W_2$ is one or more a counterions as necessary to balance the charge;

(Ib)

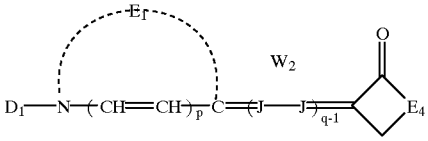

wherein:

$E_1$, $D_1$, J, p, q and $W_2$ are as defined above for formula (Ia) wherein $E_4$ represents the atoms necessary to complete a substituted or unsubstituted heterocyclic acidic nucleus which preferably contains a thiocarbonyl;

The dyes of the second dye layer do not need to be capable of spectrally sensitizing a silver halide emulsion. Preferred dyes are merocyanine dyes. It is preferable to have a positively charged dye present in the second layer and in some cases it is preferable to have both a positively and negatively charged dye present in the second layer.

Antenna dyes that could be used in an additional dye layer should have excited lifetimes that are long enough to allow energy transfer to occur. An indication of a long excited state lifetime is strong fluorescence when the dye is aggregated in aqueous gelatin. Thus, preferred antenna dyes should aggregate in aqueous gelatin and be highly fluorescent.

Particularly preferred as dyes for the second layer are dyes having structure II

II

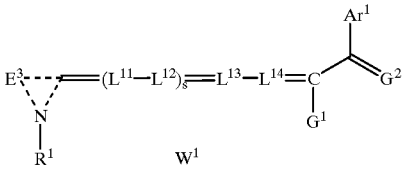

wherein:

$R^1$ is substituted or unsubstituted alkyl or aryl group. $E^3$ represents the atoms necessary to complete a substituted or unsubstituted 5- or 6-membered heterocyclic nucleus which is a basic nucleus (see *The Theory of the Photographic Process,* 4th edition, T. H. James, editor, Macmillan Publishing Co., New York, 1977, for a definition of basic and acidic nucleus). $Ar^1$ represents an electron-withdrawing substituted aryl, or a substituted or unsubstituted electron-withdrawing heteroaryl group. $L^{11}$ through $L^{14}$ represent substituted or unsubstituted methine groups; s is 0 or 1; $G^1$ is an electron-withdrawing group; $G^2$ is O or dicyanovinyl ($C(CN)_2$) and $W^1$ is a counterion if necessary.

In one preferred embodiment at least one substituent on the dye of formula II is a cationic or can be protonated to become a cationic substituent. Examples of positively charged substituents are 3-(trimethylammonio)propyl), 3-(4-ammoniobutyl), 3-(4-guanidinobutyl) etc. Other examples are any substitutents that take on a positive charge in the silver halide emulsion melt, for example, by protonation such as aminoalkyl substitutents, e.g. 3-(3-aminopropyl), 3-(3-dimethylaminopropyl), 4-(4-methylaminopropyl), etc.

In certain cases dyes of formula II which have an anionic substituent rather than a cationic substituent can be added to the photographic element and are useful for stabilizing the second dye layer. Examples of negatively charged substituents are 3-sulfopropyl, 2-carboxyethyl, 4-sulfobutyl, etc. In one preferred embodiment at least one substituent on the dye of formula II is an anionic substituent and at least one additional dye is present that has at least one cationic substituent.

$E^3$ represents the atoms necessary to complete a substituted or unsubstituted 5or 6-membered heterocyclic nucleus. These include a substituted or unsubstituted: thiazole nucleus, oxazole nucleus, selenazole nucleus, quinoline nucleus, tellurazole nucleus, pyridine nucleus, thiazoline nucleus, indoline nucleus, oxadiazole nucleus, thiadiazole nucleus, or imidazole nucleus. This nucleus may be substituted with known substituents, such as halogen (e.g., chloro, fluoro, bromo), alkoxy (e.g., methoxy, ethoxy), substituted or unsubstituted alkyl (e.g., methyl, trifluoromethyl), substituted or unsubstituted aryl, substituted or unsubstituted aralkyl, sulfonate, and others known in the art. Examples of useful nuclei for $E^3$ include: a thiazole nucleus, e.g., thiazole, 4-methylthiazole, 4-phenylthiazole, 5-methylthiazole, 5-phenylthiazole,-4,5-dimethyl-thiazole, 4,5-diphenylthiazole, 4-(2-thienyl)thiazole, benzothiazole, 4-chlorobenzothiazole, 5-chlorobenzothiazole, 6-chlorobenzothiazole, 7-chlorobenzothiazole, 4-methylbenzothiazole, 5-methylbenzothiazole, 6-methylbenzothiazole, 5-bromobenzothiazole, 6-bromobenzothiazole, 5-phenylbenzothiazole, 6-phenylbenzothiazole, 4methoxybenzothiazole, 5methoxybenzothiazole, 6-methoxybenzothiazole, 4-ethoxybenzothiazole, 5-ethoxybenzothiazole, tetrahydrobenzothiazole, 5,6-dimethoxybenzothiazole, 5,6-dioxymethylbenzothiazole, 5-hydroxybenzothiazole, 6-ethoxy-5-hydroxybenzothiazole, naphtho[2,1-d]thiazole, 5-ethoxynaphtho[2,3-d]thiazole, 8-methoxynaphtho[2, 3-d] thiazole, 7-methoxynaphtho[2,3-d]thiazole, 4'-methoxythianaphtheno-7', 6'-4,5-thiazole, etc.; an oxazole nucleus, e.g., 4-methyloxazole, 5-methyloxazole, 4-phenyloxazole, 4,5-diphenyloxazole, 4-ethyloxazole, 4,5-dimethyloxazole, 5-phenyloxazole, benzoxazole, 5-chlorobenzoxazole, 5-methylbenzoxazole, 5-phenylbenzoxazole, 6-methylbenzoxazole, 5,6-dimethylbenzoxazole, 4,6-dimethylbenzoxazole, 5-ethoxybenzoxazole, 5-chlorobenzoxazole, 6-methoxybenzoxazole, 5-hydroxybenzoxazole, 6hydroxybenzoxazole, naphtho[2,1-d]oxazole, naphtho[1,2-d]oxazole, etc.; a selenazole nucleus, e.g., 4methylselenazole, 4-phenylselenazole, benzoselenazole, 5-chlorobenzoselenazole, 5-methoxybenzoselenazole, 5-hydroxybenzoselenazole, tetrahydrobenzoselenazole, naphtho[2,1-d]selenazole, naphtho[1,2-d]selenazole, etc.; a pyridine nucleus, e.g., 2-pyridine, 5-methyl-2-pyridine, 4pyridine, 3-methyl-4-pyridine, 3-methyl-4-pyridine, etc.; a quinoline nucleus, e.g., 2-quinoline, 3-methyl-2-quinoline, 5-ethyl-2-quinoline, 6-chloro-2-quinoline, 8-chloro-2-quinoline, 6-methoxy-2-quinoline, 8-ethoxy-2-quinoline, 8-hydroxy-2-quinoline, 4-quinoline, 6-methoxy-4-quinoline, 7methyl-4-quinoline, 8-chloro-4-quinoline, etc.; a tellurazole nucleus, e.g., benzotellurazole, naphtho[1,2-d]benzotellurazole, 5,6-dimethoxybenzotellurazole, 5-methoxybenzotellurazole, 5-methylbenzotellurazole; a thiazoline nucleus, e.g.,thiazoline, 4-methylthiazoline, etc.; a benzimidazole nucleus, e.g., benzimidazole, 5-trifluoromethylbenzimidazole, 5,6-dichlorobenzimidazole; and indole nucleus, 3,3-dimethylindole, 3,3-diethylindole, 3,3,5trimethylindole; or a diazole nucleus, e.g., 5-phenyl-1,3,4oxadiazole, and 5-methyl-1,3,4thiadiazole. In one preferred embodiment, $E^3$ represents the atoms necessary to complete a substituted or unsubstituted benzoxazole nucleus.

In one preferred embodiment $R^1$ of formula II does not contains an aromatic or heteroaromatic group. These groups can sometimes increase dye stain.

In one preferred embodiment $Ar^1$ is an aromatic group that is electron-withdrawing. For example, useful dyes include dyes of formula II in which $Ar^1$ is an aryl group which has one or more substitutents, including the possibility of fused aromatic rings, and at least one of the substitutents of $Ar^1$ has a Hammett value greater or equal to 0.25 and more preferably a Hammett value of 0.40 or greater. Substituent Hammett values are well-known in the literature, for example, see C. H. Hansch, A. Leo, and R. W. Taft, *Chem. Rev.,* 91, 165–195, (1991). Preferably the Hammett $\sigma_m$ value would be used for meta substitutents and the $\sigma_p$ value would be used for para or ortho substitutents. Examples of useful substitutents for $Ar^1$ are m-CN, p-CN, o-CN, m-$SO_2CF_3$, p-$SO_2CF_3$,p-$COCF_3$, m-$COCF_3$, m-$SO_2Et$,p-$SO_2Et$, m-CHO,p-CHO, etc. Another example of useful dyes include dyes of formula II in which $Ar^1$ is an heteroaromatic group that is electron-withdrawing. In this case the heteroatom can be treated as a substituent and replacement substituent constants can be used to define the heteroaryl group's electron-withdrawing ability. Hammett replacement constants are discussed in *Correlation Analysis in Chemistry,* N. B. Chapman and J. Shorter, editors, Plenum Press, New York, 1978 and are defined for the replacement of —CH— or —CH═CH— in benzene by a heteroatom. The heteroaryl group should have a Hammett replacement substituent constant of 0.25 or greater or more preferably a Hammett replacement substituent constant of 0.40 or greater. The heteroaryl group may be unsubstituted or further substituted and may contain fused rings. In another preferred embodiment $Ar^1$ is a heteroaryl group containing at least one nitrogen atom. Examples of useful heteroaromatic groups are:

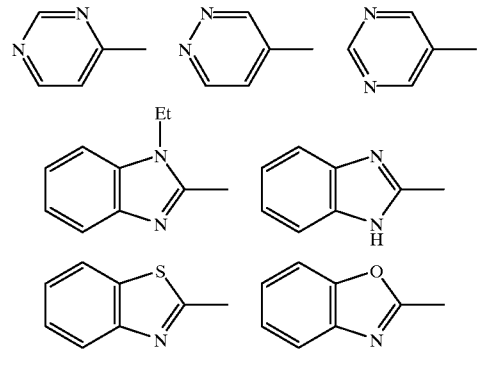

3-pyridyl, 4-pyridyl, 2-pyridyl, etc.

In another preferred embodiment, dyes of formula II are preferred wherein $E^3$ represents the atoms necessary to complete a substituted or unsubstituted benzoxazole, benzothiazole, benzimidazole, or quinoline nucleus, $G^1$ is cyano, $G^2$ is dicyanovinyl and s is 0.

In another preferred embodiment, dyes of formula II are preferred wherein $E^3$ represents the atoms necessary to complete a substituted or unsubstituted benzoxazole nucleus, $G^1$ is cyano, $G^2$ is dicyanovinyl and s is 0. In another preferred embodiment of the invention the dye for the second layer are dyes having structure IIa:

IIa

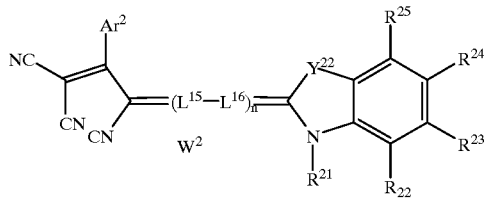

wherein:

$R^{21}$ is a substituted or unsubstituted alkyl or aryl group containing a cationic substituent;

$R^{22}$ to $R^{25}$ each individually represent hydrogen, alkyl, cycloalkyl, alkenyl, substituted or unsubstituted aryl, substituted or unsubstituted heteroaryl, substituted or unsubstituted aralkyl, alkylthio, hydroxy, hydroxylate, alkoxy, amino, alkylamino, halogen, cyano, nitro, carboxy, carboxylate, acyl, alkoxycarbonyl, aminocarbonyl, sulfonamido, sulfamoyl, including the atoms required to form fused aromatic or heteroaromatic rings;

$Ar^2$ is an electron-withdrawing substituted aryl, or a substituted or unsubstituted electron-withdrawing heteroaryl group;

$L^{15}$ and $L^{16}$ are substituted or unsubstituted methine groups;

n represents 1 or 2;

$Y^{22}$ is O, S, Te, Se, substituted or unsubstituted N, substituted or unsubstituted C═C, or substituted C;

$W^2$ is a countenion if necessary.

Particularly preferred dyes are those of formula IIa in which $Y^{22}$ is O and n=1; $Y^{22}$ is O, n=1, and at least one of $R^{22}$ to $R^{25}$ is an aromatic group; or $Y^{22}$ is O, n=1, at least one of $R^{22}$ to $R^{25}$ is an aromatic group, and $Ar^2$ is a substituted or unsubstituted pyridyl group.

In another preferred embodiment, the resulting dye forms a lyotropic liquid-crystalline phase in solvent such as an aqueous media, including hydrophilic colloids. Preferably the inventive dye forms a lyotropic liquid-crystalline phase in aqueous gelatin at a concentration of 1 weight percent or less.

When reference in this application is made to a particular moiety as a "group", this means that the moiety may itself be unsubstituted or substituted with one or more substituents (up to the maximum possible number). For example, "alkyl group" refers to a substituted or unsubstituted alkyl, while "benzene group" refers to a substituted or unsubstituted benzene (with up to six substituents). Generally, unless otherwise specifically stated, substituent groups usable on molecules herein include any groups, whether substituted or unsubstituted, which do not destroy properties necessary for the photographic utility. Examples of substituents on any of the mentioned groups can include known substituents, such as: halogen, for example, chloro, fluoro, bromo, iodo; alkoxy, particularly those "lower alkyl" (that is, with 1 to 6 carbon atoms, for example, methoxy, ethoxy; substituted or unsubstituted alkyl, particularly lower alkyl (for example, methyl, trifluoromethyl); thioalkyl (for example, methylthio or ethylthio), particularly either of those with 1 to 6 carbon atoms; substituted and unsubstituted aryl, particularly those having from 6 to 20 carbon atoms (for example, phenyl); and substituted or unsubstituted heteroaryl, particularly those having a 5 or 6-membered ring containing 1 to 3 heteroatoms selected from N, O, or S (for example, pyridyl, thienyl, furyl, pyrrolyl); acid or acid salt groups such as any of those described below; and others known in the art. Alkyl substituents may specifically include "lower alkyl" (that is, having 1–6 carbon atoms), for example, methyl, ethyl, and the like. Further, with regard to any alkyl group or alkylene group, it will be understood that these can be branched or unbranched and include ring structures.

Particularly preferred dyes for use in accordance with this invention are give in Table I, however the dyes useful in the invention are not limited to these compounds. Examples of dyes valuable for primary sensitizers are designated by the prefix I in Table I. Examples of dyes useful as antenna dyes are designated by the prefix II in the Table. As discussed previously, it is sometimes valuable to add a third antenna dye having an anionic substituent to aid in the stabilization of the antenna dye layer. Examples of these types of dyes are designated by the prefix III in the Table I.

TABLE I

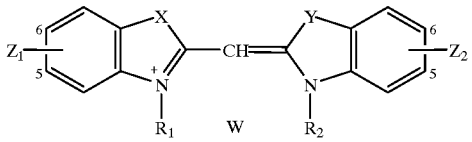

| Dye | $Z_1$ | $Z_2$ | X,Y | $R_1$ | $R_2$ | W |
|---|---|---|---|---|---|---|
| I-1 | 5-Cl | 5-Cl | S,S | $(CH_2)_3SO_3^-$ | $(CH_2)_3SO_3^-$ | $TEAH^+$ |
| I-2 | 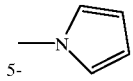 | 5-Cl | S,S | $(CH_2)_3SO_3^-$ | $(CH_2)_3SO_3^-$ | $TEAH^+$ |
| I-3 | 4,5-Benzo | 5-Cl | S,S | $(CH_2)_3SO_3^-$ | $(CH_2)_3SO_3^-$ | $TEAH^+$ |

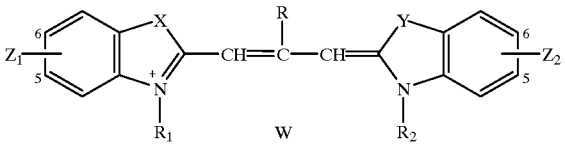

| Dye | $Z_1$ | $Z_2$ | X,Y | R | $R_1$ | $R_2$ | W |
|---|---|---|---|---|---|---|---|
| I-4 | 5-Ph | 5-Cl | O,O | Et | $—(CH_2)_2CH(CH_3)SO_3^-$ | $—(CH_2)_3SO_3^-$ | $TEAH^+$ |
| I-5 | 5-Ph | H | O,S | Et | $—C_2H_5$ | $—CH_2CONSO_2Me^-$ | — |
| I-6 | 5-Ph | 5-Ph | O,O | Et | $—(CH_2)_2CH(CH_3)SO_3^-$ | $—(CH_2)_2CH(CH_3)SO_3^-$ | $TEAH^+$ |
| I-7 | 5-Ph | 5-Ph | O,O | Et | $—(CH_2)_2SO_3^-$ | $—(CH_2)_2SO_3^-$ | $TEAH^+$ |
| I-8 | 5-Cl | 5-Cl | S,S | Et | $—(CH_2)_3SO_3^-$ | $—(CH_2)_3SO_3^-$ | $TEAH^+$ |
| I-9 | 5-Ph | 5-Cl | O,S | Et | $—(CH_2)_2CH(CH_3)SO_3^-$ | $—(CH_2)_3SO_3^-$ | $TEAH^+$ |
| I-10 | 5-Ph | H | O,S | | $—(CH_2)_3SO_3^-$ | $—CH_2CONSO_2Me^-$ | $TEAH^+$ |

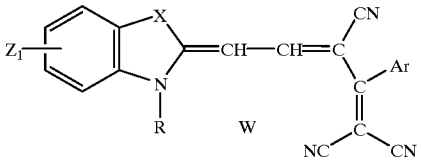

| Dye | X | R | $Z_1$ | Ar | W |
|---|---|---|---|---|---|

TABLE I-continued
| | | | | | |
|---|---|---|---|---|---|
| II-1 | O | —$(CH_2)_3N(Me)_3^+$ | 5-Ph | 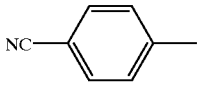 | $Br^-$ |
| II-2 | O | —$(CH_2)_3N(Et)_3^+$ | 5-Ph | 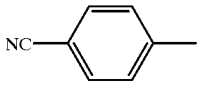 | $Br^-$ |
| II-3 | O | —$(CH_2)_3N(Me)_3^+$ | 5-Ph | 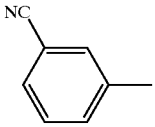 | $Br^-$ |
| II-4 | O | —$(CH_2)_3N(Me)_3^+$ | 5-Ph | 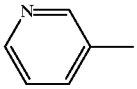 | $CH_3SO_3^-$ |
| II-5 | O | —$(CH_2)_3N(Me)_2Et^+$ | 5-Ph | 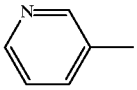 | $Br^-$ |
| II-6 | O | —$(CH_2)_3N(Et)_3^+$ | 5-Ph | 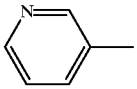 | $Br^-$ |
| II-7 | O | —$(CH_2)_3N(Me)_2Bu^+$ | 5-Ph | 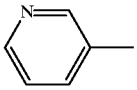 | $Br^-$ |
| II-8 | O | —$(CH_2)_3N(Me)_3^+$ | 5-Ph | 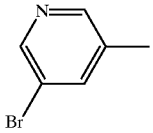 | $CH_3SO_3^-$ |
| II-9 | O | —$(CH_2)_3N(Me)_3^+$ | 5-Ph | 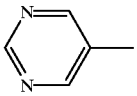 | $CH_3SO_3^-$ |
| II-10 | O | —$(CH_2)_3N(Me)_3^+$ | 5-Ph | 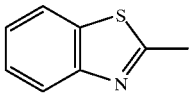 | $CH_3SO_3^-$ |
| II-11 | O | —$(CH_2)_3N(Me)_3^+$ | 5-Ph | 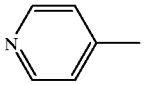 | $CH_3SO_3^-$ |
| II-12 | O | —$(CH_2)_3N(Me)_3^+$ | 5-Ph | 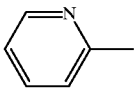 | $CH_3SO_3^-$ |
| II-13 | O | —$(CH_2)_4$—$C^+(NH_2)_2$ | 5-Ph | 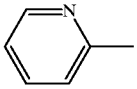 | $CH_3SO_3^-$ |

TABLE I-continued
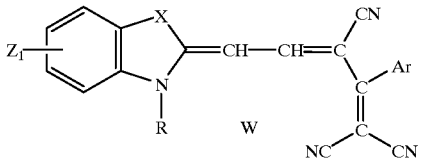
| Dye | X | R | $Z_1$ | Ar | W |
|---|---|---|---|---|---|
| III-1 | O | $—(CH_2)_3SO_3^-$ | 5-Ph | 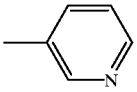 | $Na^+$ |
| III-2 | O | $—(CH_2)_4SO_3^-$ | 5-Ph | 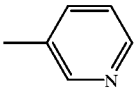 | $Na^+$ |
| III-3 | O | $—(CH_2)_2CH(CH_3)SO_3^-$ | 5-Ph | 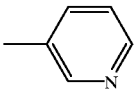 | $Na^+$ |
| III-4 | O | $—(CH_2)_3SO_3^-$ | 5-F | 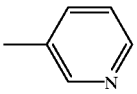 | $Na^+$ |
| III-5 | O | $—(CH_2)_3SO_3^-$ | 5-Cl | 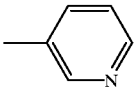 | $Na^+$ |
| III-6 | O | $—(CH_2)_3SO_3^-$ | 5-Ph | 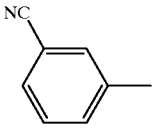 | $Na^+$ |
| III-7 | O | $—(CH_2)_2CH(CH_3)SO_3^-$ | 5-Ph | 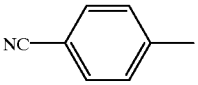 | $Et_3NH^+$ |
| III-8 | O | $—(CH_2)_3SO_3^-$ | 5-Ph | 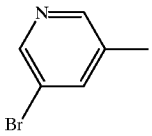 | $Na^+$ |
| III-9 | O | $—(CH_2)_3SO_3^-$ | 5-Ph | 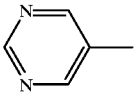 | $Na^+$ |
| III-10 | O | $—(CH_2)_3SO_3^-$ | 5-Ph | 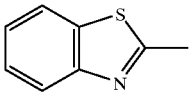 | $Na^+$ |
| III-11 | O | $—(CH_2)_3SO_3^-$ | 5-Ph | 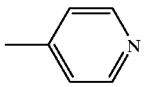 | $Na^+$ |

The silver halide may be sensitized by sensitizing dyes by any method known in the art. The dyes may, for example, be added as a solution or dispersion in water or an alcohol, aqueous gelatin, alcoholic aqueous gelatin, etc. The dye/silver halide emulsion may be mixed with a dispersion of color image-forming coupler immediately before coating or in advance of coating (for example, 2 hours).

The emulsion layer of the photographic element of the invention can comprise any one or more of the light sensitive layers of the photographic element. The photographic elements made in accordance with the present invention can be black and white elements, single color elements or multicolor elements. Multicolor elements contain dye image-forming units sensitive to each of the three primary regions of the spectrum. Each unit can be comprised of a single emulsion layer or of multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

In the following discussion of suitable materials for use in elements of this invention, reference will be made to *Research Disclosure,* September 1996, Number 389, Item 38957, which will be identified hereafter by the term "*Research Disclosure I.*" The Sections hereafter referred to are Sections of the *Research Disclosure I* unless otherwise indicated. All Research Disclosures referenced are published by Kenneth Mason Publications, Ltd., Dudley Annex, 12a North Street, Emsworth, Hampshire P010 7DQ, ENGLAND. The foregoing references and all other references cited in this application, are incorporated herein by reference.

The silver halide emulsions employed in the photographic elements of the present invention may be negative-working, such as surface-sensitive emulsions or unfogged internal latent image forming emulsions, or positive working emulsions of the internal latent image forming type (that are fogged during processing). Suitable emulsions and their preparation as well as methods of chemical and spectral sensitization are described in Sections I through V. Color materials and development modifiers are described in Sections V through XX. Vehicles which can be used in the photographic elements are described in Section II, and various additives such as brighteners, antifoggants, stabilizers, light absorbing and scattering materials, hardeners, coating aids, plasticizers, lubricants and matting agents are described, for example, in Sections VI through XIII. Manufacturing methods are described in all of the sections, layer arrangements particularly in Section XI, exposure alternatives in Section XVI, and processing methods and agents in Sections XIX and XX.

With negative working silver halide a negative image can be formed. Optionally a positive (or reversal) image can be formed although a negative image is typically first formed.

The silver halide used in the photographic elements may be silver iodobromide, silver bromide, silver chloride, silver chlorobromide, silver chloroiodobromide, and the like.

The type of silver halide grains preferably include polymorphic, cubic, and octahedral. The grain size of the silver halide may have any distribution known to be useful in photographic compositions, and may be either polydispersed or monodispersed. Tabular grain silver halide emulsions may also be used.

The silver halide grains to be used in the invention may be prepared according to methods known in the art, such as those described in *Research Disclosure I* and *The Theory of the Photographic Process,* $4^{th}$ edition, T. H. James, editor, Macmillan Publishing Co., New York, 1977. These include methods such as ammoniacal emulsion making, neutral or acidic emulsion making, and others known in the art. These methods generally involve mixing a water soluble silver salt with a water soluble halide salt in the presence of a protective colloid, and controlling the temperature, pAg, pH values, etc, at suitable values during formation of the silver halide by precipitation.

In the course of grain precipitation one or more dopants (grain occlusions other than silver and halide) can be introduced to modify grain properties. For example, any of the various conventional dopants disclosed in *Research Disclosure, I,* Section I. Emulsion grains and their preparation, sub-section G. Grain modifying conditions and adjustments, paragraphs (3), (4) and (5), can be present in the emulsions of the invention. In addition it is specifically contemplated to dope the grains with transition metal hexacoordination complexes containing one or more organic ligands, as taught by Olm et al U.S. Pat. No. 5,360,712, the disclosure of which is here incorporated by reference.

It is specifically contemplated to incorporate in the face centered cubic crystal lattice of the grains a dopant capable of increasing imaging speed by forming a shallow electron trap (hereinafter also referred to as a SET) as discussed in *Research Disclosure* Item 36736 published November 1994, here incorporated by reference.

The SET dopants are effective at any location within the grains. Generally better results are obtained when the SET dopant is incorporated in the exterior 50 percent of the grain, based on silver. An optimum grain region for SET incorporation is that formed by silver ranging from 50 to 85 percent of total silver forming the grains. The SET can be introduced all at once or run into the reaction vessel over a period of time while grain precipitation is continuing. Generally SET forming dopants are contemplated to be incorporated in concentrations of at least $1\times10^{-7}$ mole per silver mole up to their solubility limit, typically up to about $5\times10^{-4}$ mole per silver mole.

SET dopants are known to be effective to reduce reciprocity failure. In particular the use of iridium hexacoordination complexes or $Ire^{+4}$ complexes as SET dopants is advantageous.

Iridium dopants that are ineffective to provide shallow electron a traps (non-SET dopants) can also be incorporated into the grains of the silver halide grain emulsions to reduce reciprocity failure.

To be effective for reciprocity improvement the Ir can be present at any location within the grain structure. A preferred location within the grain structure for Ir dopants to produce reciprocity improvement is in the region of the grains formed after the first 60 percent and before the final 1 percent (most preferably before the final 3 percent) of total silver forming the grains has been precipitated. The dopant can be introduced all at once or run into the reaction vessel over a period of time while grain precipitation is continuing. Generally reciprocity improving non-SET Ir dopants are contemplated to be incorporated at their lowest effective concentrations.

The contrast of the photographic element can be further increased by doping the grains with a hexacoordination complex containing a nitrosyl or thionitrosyl ligand (NZ dopants) as disclosed in McDugle et al U.S. Pat. No. 4,933,272, the disclosure of which is here incorporated by reference.

The contrast increasing dopants can be incorporated in the grain structure at any convenient location. However, if the NZ dopant is present at the surface of the grain, it can reduce the sensitivity of the grains. It is therefore preferred that the NZ dopants be located in the grain so that they are separated from the grain surface by at least 1 percent (most preferably at least 3 percent) of the total silver precipitated in forming the silver iodochloride grains. Preferred contrast enhancing concentrations of the NZ dopants range from $1\times10^{-11}$ to $4\times10^{-8}$ mole per silver mole, with specifically preferred concentrations being in the range from $10^{-10}$ to $10^{-8}$ mole per silver mole.

Although generally preferred concentration ranges for the various SET, non-SET Ir and NZ dopants have been set out above, it is recognized that specific optimum concentration ranges within these general ranges can be identified for specific applications by routine testing. It is specifically contemplated to employ the SET, non-SET Ir and NZ dopants singly or in combination. For example, grains containing a combination of an SET dopant and a non-SET Ir dopant are specifically contemplated. Similarly SET and NZ dopants can be employed in combination. Also NZ and Ir dopants that are not SET dopants can be employed in combination. Finally, the combination of a non-SET Ir dopant with a SET dopant and an NZ dopant. For this latter three-way combination of dopants it is generally most convenient in terms of precipitation to incorporate the NZ dopant first, followed by the SET dopant, with the non-SET Ir dopant incorporated last.

In one preferred embodiment, a molecule containing a group that strongly bonds to silver halide, such as a mercapto group (or a molecule that forms a mercapto group under alkaline or acidic conditions) or a thiocarbonyl group is added after the first dye layer has been formed and before the second dye layer is formed. Mercapto compounds represented by the following formula (A) are particularly preferred. Also, mercaptotriazoles and 2-mercaptoimidazoles are useful.]

A

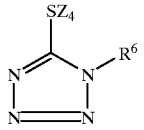

wherein $R_6$ represents an alkyl group, an alkenyl group or an aryl group and $Z_4$ represents a hydrogen atom, an alkali metal atom, an ammonium group or a protecting group that can be removed under alkaline or acidic conditions. Examples of some preferred mercapto compounds are shown below.

A-1

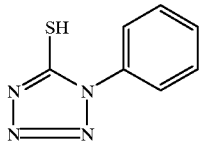

A-2

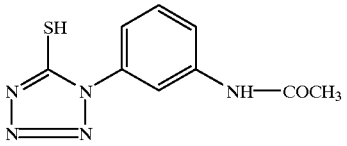

-continued

A-3

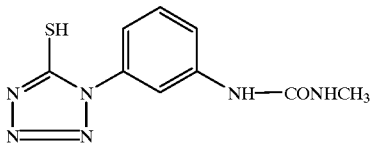

A-4

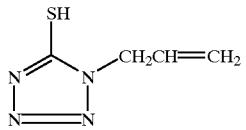

A-5

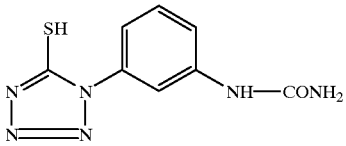

The photographic elements of the present invention, as is typical, provide the silver halide in the form of an emulsion. Photographic emulsions generally include a vehicle for coating the emulsion as a layer of a photographic element. Useful vehicles include both naturally occurring substances such as proteins, protein derivatives, cellulose derivatives (e.g., cellulose esters), gelatin (e.g., alkali-treated gelatin such as cattle bone or hide gelatin, or acid treated gelatin such as pigskin gelatin), deionized gelatin, gelatin derivatives (e.g., acetylated gelatin, phthalated gelatin, and the like), and others as described in *Research Disclosure I.* Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers, and the like, as described in *Research Disclosure I.* The vehicle can be present in the emulsion in any amount useful in photographic emulsions. The emulsion can also include any of the addenda known to be useful in photographic emulsions.

The silver halide to be used in the invention may be advantageously subjected to chemical sensitization. Compounds and techniques useful for chemical sensitization of silver halide are known in the art and described in *Research Disclosure I* and the references cited therein. Compounds useful as chemical sensitizers, include, for example, active gelatin, sulfur, selenium, tellurium, gold, platinum, palladium, iridium, osmium, rhenium, phosphorous, or combinations thereof. Chemical sensitization is generally carried out at pAg levels of from 5 to 10, pH levels of from 4 to 8, and temperatures of from 30 to 800° C., as described in *Research Disclosure I,* Section IV (pages 510–511) and the references cited therein.

The photographic elements of the present invention may also use colored couplers (e.g. to adjust levels of interlayer correction) and masking couplers such as those described in EP 213 490; Japanese Published Application 58-172,647; U.S. Pat. No. 2,983,608; German Application DE 2,706,117C; U.K. Patent 1,530,272; Japanese Application A-113935; U.S. Pat. No. 4,070,191 and German Application DE 2,643,965. The masking couplers may be shifted or blocked.

The photographic elements may also contain materials that accelerate or otherwise modify the processing steps of bleaching or fixing to improve the quality of the image. Bleach accelerators described in EP 193 389; EP 301 477; U.S. Pat. Nos. 4,163,669; 4,865,956; and 4,923,784 are particularly useful accelerators or their precursors (UK Patent 2,097,140; U.K. Patent 2,131,188); development inhibitors and their precursors (U.S. Pat. Nos. 5,460,932; 5,478,711); electron transfer agents (U.S. Pat. Nos. 4,859, 578; 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The elements may also contain filter dye layers comprising colloidal silver sol or yellow and/or magenta filter dyes and/or antihalation dyes (particularly in an undercoat beneath all light sensitive layers or in the side of the support opposite that on which all light sensitive layers are located) either as oil-in-water dispersions, latex dispersions or as solid particle dispersions. Additionally, they may be used with "smearing" couplers (e.g. as described in U.S. Pat. No. 4,366,237; EP 096 570; U.S. Pat. Nos. 4,420,556; and 4,543,323.) Also, the couplers may be blocked or coated in protected form as described, for example, in Japanese Application 61/258,249 or U.S. Pat. No. 5,019,492.

The photographic elements may further contain other image-modifying compounds such as "Development Inhibitor-Releasing" compounds (DIR's). Useful additional DIR's for elements of the present invention, are known in the art and examples are described in U.S. Patent Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032, 914; GB 2,099,167; DE 2,842,063, DE 2,937,127; DE 3,636,824; DE 3,644,416 as well as the following European Patent Publications: 272,573; 335,319; 336,411; 346,899; 362,870; 365,252; 365,346; 373,382; 376,212; 377,463; 378,236; 384,670; 396,486; 401,612; 401,613.

DIR compounds are also disclosed in "Developer-Inhibitor-Releasing (DIR) Couplers for Color Photography," C. R. Barr, J. R. Thirtle and P. W. Vittum in *Photographic Science and Engineering,* Vol. 13, p. 174 (1969), incorporated herein by reference.

It is also contemplated that the concepts of the present invention may be employed to obtain reflection color prints as described in Research Disclosure, November 1979, Item 18716, incorporated herein by reference. The emulsions and materials to form elements of the present invention, may be coated on pH adjusted support as described in U.S. Pat. No. 4,917,994; with epoxy solvents (EP 0 164 961); with additional stabilizers (as described, for example, in U.S. Pat. Nos. 4,346,165; 4,540,653 and 4,906,559); with ballasted chelating agents such as those in U.S. Pat. No. 4,994,359 to reduce sensitivity to polyvalent cations such as calcium; and with stain reducing compounds such as described in U.S. Pat. Nos. 5,068,171 and 5,096,805. Other compounds which maybe useful in the elements of the invention are disclosed in Japanese Published Applications 83-09,959; 83-62,586; 90-072,629; 90-072,630; 90-072,632; 90-072,633; 90-072, 634; 90-077,822; 90-078,229; 90-078,230; 90-079,336; 90-079,338; 90-079,690; 90-079,691; 90-080,487; 90-080, 489; 90-080,490; 90080,491; 90-080,492; 90-080,494; 90-085,928; 90-086,669; 90-086,670; 90-087,361; 90-087, 362; 90-087,363; 90-087,364; 90-088,096; 90-088,097; 90-093,662; 90-093,663; 90-093,664; 90-093,665; 90-093, 666; 90-093,668; 90-094,055; 90-094,056; 90-101,937; 90-103,409; 90-151,577.

Photographic elements of the present invention are preferably imagewise exposed using any of the known techniques, including those described in *Research Disclosure I,* Section XVI. This typically involves exposure to light in the visible region of the spectrum, and typically such exposure is of a live image through a lens, although exposure can also be exposure to a stored image (such as a computer stored image) by means of light emitting devices (such as light emitting diodes, CRT and the like).

Photographic elements comprising the composition of the invention can be processed in any of a number of well-known photographic processes utilizing any of a number of well-known processing compositions, described, for example, in *Research Disclosure I,* or in *The Theory of the Photographic Process,* $4^{th}$ edition, T. H. James, editor, Macmillan Publishing Co., New York, 1977. In the case of processing a negative working element, the element is treated with a color developer (that is one which will form the colored image dyes with the color couplers), and then with a oxidizer and a solvent to remove silver and silver halide. In the case of processing a reversal color element, the element is first treated with a black and white developer (that is, a developer which does not form colored dyes with the coupler compounds) followed by a treatment to fog silver halide (usually chemical fogging or light fogging), followed by treatment with a color developer. Preferred color developing agents are p-phenylenediamines. Especially preferred are:

4-amino N,N-diethylaniline hydrochloride,
4-amino-3-methyl-N,N-diethylaniline hydrochloride,
4-amino-3-methyl-N-ethyl-N-(α-(methanesulfonamido) ethylaniline sesquisulfate hydrate,
4-amino-3-methyl-N-ethyl-N-(α-hydroxyethyl)aniline sulfate,
4-amino-3-α-(methanesulfonamido)ethyl-N,N-diethylaniline hydrochloride and
4-amino-N-ethyl-N-(2-methoxyethyl)-m-toluidine di-p-toluene sulfonic acid.

Dye images can be formed or amplified by processes which employ in combination with a dye-image-generating reducing agent an inert transition metal-ion complex oxidizing agent, as illustrated by Bissonette U.S. Pat. Nos. 3,748,138, 3,826,652, 3,862,842 and 3,989,526 and Travis U.S. Pat. No. 3,765,891, and/or a peroxide oxidizing agent as illustrated by Matejec U.S. Pat. No. 3,674,490, *Research Disclosure,* Vol. 116, December, 1973, Item 11660, and Bissonette *Research Disclosure,* Vol. 148, August, 1976, Items 14836, 14846 and 14847. The photographic elements can be particularly adapted to form dye images by such processes as illustrated by Dunn et al U.S Pat. No. 3,822, 129, Bissonette U.S. Pat. Nos. 3,834,907 and 3,902,905, Bissonette et al U.S. Pat. No. 3,847,619, Mowrey U.S. Pat. No. 3,904,413, Hirai et al U.S. Pat. No. 4,880,725, Iwano U.S. Pat. No. 4,954,425, Marsden et al U.S. Pat. No. 4,983,504, Evans et al U.S. Pat. No. 5,246,822, Twist U.S. Pat. No. 5,324,624, Fyson EPO 0 487 616, Tannahill et al WO 90/13059, Marsden et al WO 90/13061, Grimsey et al WO 91/16666, Fyson WO 91/17479, Marsden et al WO 92/01972. Tannahill WO 92/05471, Henson WO 92/07299, Twist WO 93/01524 and WO 93/11460 and Wingender et al German OLS 4,211,460.

Development is followed by bleach-fixing, to remove silver or silver halide, washing and drying.

The photographic elements of this invention may be processed utilizing either conventional processing systems, described above, or low volume processing systems.

Low volume systems are those where film processing is initiated by contact to a processing solution, but where the processing solution volume is comparable to the total volume of the imaging layer to be processed. This type of system may include the addition of non-solution processing aids, such as the application of heat or of a laminate layer that is applied at the time of processing. Conventional photographic systems are those where film elements are processed by contact with conventional photographic processing solutions, and the volume of such solutions is very large in comparison to the volume of the imaging layer.

Low volume processing is defined as processing where the volume of applied developer solution is between about 0.1 to about 10 times, preferably about 0.5 to about 10 times, the volume of solution required to swell the photographic element. This processing may take place by a combination of solution application, external layer lamination, and heating. The low volume system photographic element may receive some or all of the following treatments:

(I) Application of a solution directly to the film by any means, including spray, inkjet, coating, gravure process and the like.

(II) Soaking of the film in a reservoir containing a processing solution. This process may also take the form of dipping or passing an element through a small cartridge.

(III) Lamination of an auxiliary processing element to the imaging element. The laminate may have the purpose of providing processing chemistry, removing spent chemistry, or transferring image information from the latent image recording film element. The transferred image may result from a dye, dye precursor, or silver containing compound being transferred in a image-wise manner to the auxiliary processing element.

(IV) Heating of the element by any convenient means, including a simple hot plate, iron, roller, heated drum, microwave heating means, heated air, vapor, or the like. Heating may be accomplished before, during, after, or throughout any of the preceding treatments I–III. Heating may cause processing temperatures ranging from room temperature to 100° C.

Photographic elements and methods of processing such elements particularly suitable for use with this invention are described in *Research Disclosure,* February 1995, Item 37038, incorporated herein by reference.

The processed photographic elements of this invention may serve as origination material for some or all of the following processes: image scanning to produce an electronic rendition of the capture image, and subsequent digital processing of that rendition to manipulate, store, transmit, output, or display electronically that image. A number of modifications of color negative elements have been suggested for accommodating scanning, as illustrated by *Research Disclosure,* I Section XIV. Scan facilitating features *Research Disclosure,* and *Research Disclosure* September 1994, Item 36544. These systems are contemplated for use in the practice of this invention. Further examples of such processes and useful film features are also described in U.S. Pat. Nos. 5,840,470; 6,045,938; 6,021,277; EP 961,482 and EP905,651

For example, it is possible to scan the photographic element successively within the blue, green, and red regions of the spectrum or to incorporate blue, green, and red light within a single scanning beam that is divided and passed through blue, green, and red filters to form separate scanning beams for each color record. A simple technique is to scan the photographic element point-by-point along a series of laterally offset parallel scan paths. The intensity of light passing through the element at a scanning point is noted by a sensor, which converts radiation received into an electrical signal. Most generally this electronic signal is further manipulated to form a useful electronic record of the image. For example, the electrical signal can be passed through an analog-to-digital converter and sent to a digital computer together with location information required for pixel (point) location within the image. In another embodiment, this electronic signal is encoded with colorimetric or tonal information to form an electronic record that is suitable to allow reconstruction of the image into viewable forms such as computer monitor displayed images, television images, printed images, and so forth.

It is contemplated that many of imaging elements of this invention will be scanned prior to the removal of silver halide from the element. The remaining silver halide yields a turbid coating, and it is found that improved scanned image quality for such a system can be obtained by the use of scanners that employ diffuse illumination optics. Any technique known in the art for producing diffuse illumination can be used. Preferred systems include reflective systems, that employ a diffusing cavity whose interior walls are specifically designed to produce a high degree of diffuse reflection, and transmissive systems, where diffusion of a beam of specular light is accomplished by the use of an optical element placed in the beam that serves to scatter light. Such elements can be either glass or plastic that either incorporate a component that produces the desired scattering, or have been given a surface treatment to promote the desired scattering.

One of the challenges encountered in producing images from information extracted by scanning is that the number of pixels of information available for viewing is only a fraction of that available from a comparable classical photographic print. It is, therefore, even more important in scan imaging to maximize the quality of the image information available. Enhancing image sharpness and minimizing the impact of aberrant pixel signals (i.e., noise) are common approaches to enhancing image quality. A conventional technique for minimizing the impact of aberrant pixel signals is to adjust each pixel density reading to a weighted average value by factoring in readings from adjacent pixels, closer adjacent pixels being weighted more heavily. The elements of the invention can have density calibration patches derived from one or more patch areas on a portion of unexposed photographic recording material that was subjected to reference exposures, as described by Wheeler et al U.S. Pat. No. 5,649,260, Koeng at al U.S. Pat. No. 5,563,717, Cosgrove et al U.S. Pat. No. 5,644,647, and Reem and Sutton U.S. Pat. No. 5,667,944.

Illustrative systems of scan signal manipulation, including techniques for maximizing the quality of image records, are disclosed by Bayer U.S. Pat. No. 4,553,156; Urabe et al U.S. Pat. No. 4,591,923; Sasaki et al U.S. Pat. No. 4,631,578; Alkofer U.S. Pat. No. 4,654,722; Yamada et al U.S. Pat. No. 4,670,793; Klees U.S. Pat. Nos. 4,694,342 and 4,962,542; Powell U.S. Pat. No. 4,805,031; Mayne et al U.S. Pat. No. 4,829,370; Abdulwahab U.S. Pat. No. 4,839,721; Matsunawa et al U.S. Pat. Nos. 4,841,361 and 4,937,662; Mizukoshi et al U.S. Pat. No. 4,891,713; Petilli U.S. Pat. No. 4,912,569; Sullivan et al U.S. Pat. Nos. 4,920,501 and 5,070,413; Kimoto et al U.S. Pat. No. 4,929,979; Hirosawa et al U.S. Pat. No. 4,972,256; Kaplan U.S. Pat. No. 4,977,521; Sakai U.S. Pat. No. 4,979,027; Ng U.S. Pat. No. 5,003,494; Katayama et al U.S. Pat. No. 5,008,950; Kimura et al U.S. Pat. No. 5,065,255; Osamu et al U.S. Pat. No. 5,051,842; Lee et al U.S. Pat. No. 5,012,333; Bowers et al U.S. Pat. No. 5,107,346; Telle U.S. Pat. No. 5,105,266; MacDonald et al U.S. Pat. No. 5,105,469; and Kwon et al U.S. Pat. No. 5,081,692. Techniques for color balance adjustments during scanning are disclosed by Moore et al U.S. Pat. No. 5,049,984 and Davis U.S. Pat. No. 5,541,645. Color image reproduction of scenes with color enhancement and preferential tone-scale mapping are described by Burh et al. in U.S. Pat. Nos. 5,300,381 and 5,528,339.

The digital color records once acquired are in most instances adjusted to produce a pleasingly color balanced image for viewing and to preserve the color fidelity of the image bearing signals through various transformations or renderings for outputting, either on a video monitor or when printed as a conventional color print. Preferred techniques for transforming image bearing signals after scanning are disclosed by Giorgianni et al U.S. Pat. No. 5,267,030, the disclosures of which are herein incorporated by reference. The signal transformation techniques of Giorgianni et al '030 described in connection with FIG. 8 represent a specifically preferred technique for obtaining a color balanced image for viewing.

Further illustrations of the capability of those skilled in the art to manage color digital image information are provided by Giorgianni and Madden *Digital Color Management,* Addison-Wesley, 1998.

Photographic elements of the present invention may also usefully include a magnetic recording material as described in *Research Disclosure,* Item 34390, November 1992, or a transparent magnetic recording layer such as a layer containing magnetic particles on the underside of a transparent support as in U.S. Pat. Nos. 4,279,945 and 4,302,523. The element typically will have a total thickness (excluding the support) of from 5 to 30 microns. While the order of the color sensitive layers can be varied, they will normally be red-sensitive, green-sensitive and blue-sensitive, in that order on a transparent support, (that is, blue sensitive furthest from the support) and the reverse order on a reflective support being typical.

The present invention also contemplates the use of photographic elements of the present invention in what are often referred to as single use cameras (or "film with lens" units). These cameras are sold with film preloaded in them and the entire camera is returned to a processor with the exposed film remaining inside the camera. Such cameras may have glass or plastic lenses through which the photographic element is exposed.

The following examples illustrate the use of sensitizing dyes in accordance with this invention.

Example of Dye Synthesis

Quaternary salt intermediates and dyes were prepared by standard methods such as described in Hamer, *Cyanine Dyes and Related Compounds,* 1964 (publisher John Wiley & Sons, New York, N.Y.) and *The Theory of the Photogaphic Process,* $4^{th}$ edition, T. H. James, editor, Macmillan Publishing Co., New York, 1977. For example, (3-Bromopropyl)trimethylammonium bromide was obtained from Aldrich. The bromide salt was converted to the hexafluorophosphate salt to improve the compounds solubility in valeronitrile. Reaction of a dye base with 3-(bromopropyl)trimethylammonium hexafluorophosphate in valeronitrile at 135° C. gave the corresponding quatemary salt. For example, reaction of 2-methyl-5-phenylbenzoxazole with 3-(bromopropyl) trimethylammonium hexafluorophosphate gave 2-methyl-5-phenyl-(3-(trimethylammonio)propyl)benzoxazolium bromide hexafluorophosphate. Which could be converted to the bis-bromide salt with tetrabutylammonium bromide. Dyes were prepared from quaternary salt intermediates. For example see the procedures in U.S. Pat. No. 5,213,956.

Example of Influence of Substitutents on Dye Bleaching in Solution

A sulfite or carbonate bleach assay was used to determine the level of reactivity of representative dyes. Aqueous sulfite and carbonate solutions (see Table A) that model various photographic developers were prepared. The pH of each solution was adjusted to 10.0. A dye solution was prepared at a concentration such that the dye's optical absorption was about 1 absorbance units ±/−0.2 absorbance units. Dye solutions were added to the sulfite or carbonate solutions and spectra were measured over defined time (see Table A) and compared to a control solution. The change of optical density in a given time period is a measure of dye bleaching (Table B-1 and B-2). Representative dyes from Table 1 were examined and results are listed in Table B-1 and B-2.

TABLE A

| Test | Time (min.) | Chemical | Concentration (mmole) |
|---|---|---|---|
| A1 | 1 | $K_2SO_3$ | 3.2 |
| $B_1$ | 1 | $K_2SO_3$ | 35 |
| $C_1$ | 1 | $K_2SO_3$ | 158 |
| $A_5$ | 5 | $K_2SO_3$ | 3.2 |
| $B_5$ | 5 | $K_2SO_3$ | 35 |
| $X_5$ | 5 | $K_2CO_3$ | 0.22 |

TABLE B-1

| | | Percent Cationic Dye Bleached | | | | | | | |
|---|---|---|---|---|---|---|---|---|---|
| Dye | σ(X)* | $A_1$ | $A_5$ | $B_1$ | $B_5$ | $C_1$ | $X_1$ | $X_5$ | |
| II-4 | 0.53 | 95 | 100 | 100 | 100 | 100 | 79 | 100 | Invention |
| II-3 | 0.56 | 100 | 100 | — | — | 100 | 78 | 100 | Invention |
| II-1 | 0.66 | 95 | 100 | 100 | 100 | 100 | 69 | 97 | Invention |
| D-1 | 0.00 | 69 | 98 | 100 | 100 | 100 | 49 | 90 | Comparison |
| D-2 | 0.23 | 22 | 52 | 100 | 100 | 100 | 30 | 42 | Comparison |

TABLE B-1-continued

| Dye | σ(X)* | $A_1$ | $A_5$ | $B_1$ | $B_5$ | $C_1$ | $X_1$ | $X_5$ |
|---|---|---|---|---|---|---|---|---|
| | | | Percent Cationic Dye Bleached | | | | | |

*If Ar (Table 1) is an aryl group, then σ(X) is the Hammett value of the substituent on Ar taken from C. H. Hansch, A. Leo, and R. W. Tafi, Chem. Rev., 91 165–195, (1991). If Ar is a heteroaryl group then σ(X) is the Hammett replacement substituent constant taken from Correlation Analysis in Chemistry, N. B. Chapman and J. Shorter, editors, Plenum Press, New York, 1978. Where more than one value is listed in the reference literature an average of the values listed was taken.

TABLE B-2

| Dye | σ(X)* | $A_1$ | $A_5$ | $B_1$ | $B_5$ | $C_1$ | $X_1$ | $X_5$ | |
|---|---|---|---|---|---|---|---|---|---|
| | | | Percent Anionic Dye Bleached | | | | | | |
| III-6 | 0.56 | 48 | 93 | 92 | 100 | 100 | 39 | 87 | Invention |
| III-3 | 0.53 | 56 | 100 | 89 | 100 | 100 | 39 | 95 | Invention |
| D-3 | 0.00 | 08 | 29 | 35 | 84 | 97 | 11 | 14 | Comparison |
| D-4 | 0.12 | 35 | 77 | 59 | 96 | 86 | 31 | 72 | Comparison |

*If Ar (Table 1) is an aryl group, then σ(X) is the Hammett value of the substituent on Ar taken from C. H. Hansch, A. Leo, and R. W. Tafi, Chem. Rev., 91 165–195, (1991). If Ar is a heteroaryl group then σ(X) is the Hammett replacement substituent constant taken from Correlation Analysis in Chemistry, N. B. Chapman and J. Shorter, editors, Plenum Press, New York, 1978. Where more than one value is listed in the reference literature an average of the values listed was taken.

This example indicates that certain substitutents can enhance the bleaching rate of the invention dyes. This can be highly desirable in certain photographic elements where retained dye contributes to undesirable Dmin increases.

D1

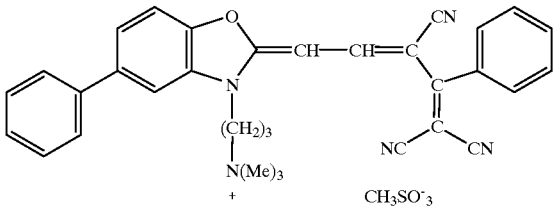

D2

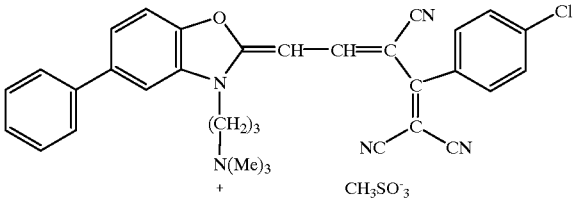

D3

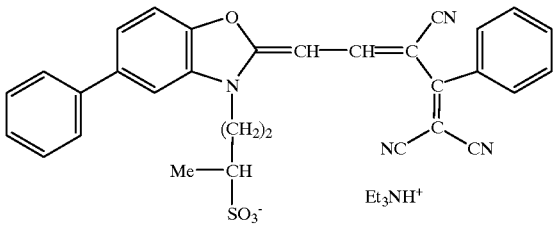

-continued

D4

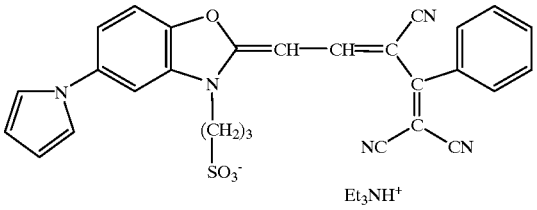

Photographic Evaluation

EXAMPLE 1

Film coating evaluations were carried out on a 0.98×0.128 μm silver bromoiodide (overall iodide content 4.5%) tabular grain emulsion. Details of the precipitation of this emulsion can be found in the description of the preparation of Emulsion A in Lin, et al., U.S. Ser. No. 08/985,532, incorporated herein by reference, except that the molar percentage of silver iodide was 4.5% in the present case rather than 2% for Emulsion A. The emulsion contained 3 mg/silver mole of tripotassium hexachloroiridate ($K_3Ir(Cl)_6$) and 0.2 mg/silver mole of potassium selenocyanate. The emulsion (0.0143 moles) was heated to 40° C. and sodium thiocyanate (100 mg/Ag mole) was added. Then after 5 minutes an antifoggant, [(3-(3-((methylsulfonyl)amino)-3-oxopropyl)-benzothiazolium tetrafluoroborate] (35 mg/Ag-mole) was added and after a 5 minute hold the first sensitizing dye, I-4 at 0.706 mmol/Ag mol, was added. After another 20' the second sensitizing dye, I-5 at 0.176 mmol/Ag mol, was added. After an additional 20' a gold salt, trisodium dithiosulfato gold (I) was added (2.19 mg/Ag mole) and two minutes later, sodium thiosulfate pentahydrate ( 1.03 mg/Ag-mole)was also added. The melt was held for 2' and then heated to 60° C. for 22'. After cooling to 40° C. 1-(3-acetamidophenyl)-5-mercaptotetrazole (compound A-2, 75 mg/Ag mole) and tetrazaindine (0.5 g/Ag mole) were added.

At 40° C. the antenna dye (see Table II for dye), when present, was added to the melt at a level of 1.5 mmol/Ag mol. After 30' at 40° C., gelatin (647 g/Ag mole total), distilled water (sufficient to bring the final concentration to 0.11 Ag mmole/g of melt) were added.

Single-layer coatings were made on acetate support. Total gelatin laydown was 3.2 g/m$^2$ (300 mg/ft$^2$). Silver laydown was 0.80 g/m$^2$ (75 mg/ft$^2$). The emulsion was combined with a coupler dispersion containing coupler C-1 just prior to coating.

Sensitometric exposures (0.01 sec) were done using 365 nm Hg-line exposure or tungsten exposure with filtration to stimulate a daylight exposure. The described elements were processed for 3.25' in the known C-41 color process as described in *Brit. J. Photog. Annual* of 1988, p191–198 with the exception that the composition of the bleach solution was changed to comprise propylenediaminetetraacetic acid.

To determine the amount of dye stain, unexposed coatings were processed as described in Table P1. Since this processing contains no silver halide developer any remaining color density is due to the stain from residual sensitizing dye. This density was measured using a conventional photographic densitometer equipped with appropriate transmission filters to selectively determine the red, green or blue wide-band transmission densities as described in Chapter 18 of "*The Theory of the Photographic Process*", Fourth edition, T. H. James, editor. The highest of these densities, in the present Examples the green density, was used as the dye stain. Results are shown in the Table II.

Table P1 Stain Processing

| | |
|---|---|
| 1. pH 10 phosphate buffer | 3.25 min |
| 2. bleach | 4 min |
| 3. wash | 3 min |
| 4. fixer | 4 min |
| 5. wash | 3 min |
| 6. stabilizer | 1 min |

The composition of the bleach and fixer solutions are given below:

| | |
|---|---|
| **Bleach** | |
| Ammonium bromide | 25 g/L |
| 1,3-Propanediaminetetraacetic acid | 37.40 g/L |
| Ammonium hydroxide (28%) | 70.00 mL/L |
| Ferric nitrate nonahydrate | 44.85 g/L |
| Glacial acetic acid | 80.00 mL/L |
| 1,3-diamino-2-propanoltetraacetic acid | 0.80 g/L |
| Water to make | 1.00 L |
| **Fixer** | |
| Ammonium thiosulfate solution 56.5% ammonium thiosulfate 4% ammonium sulfite | 162.00 mL/L |
| Sodium metabisulfite | 11.85 g/L |
| Sodium hydroxide (50%) | 2.00 mL/L |
| Water to make | 1.00 L |

TABLE II

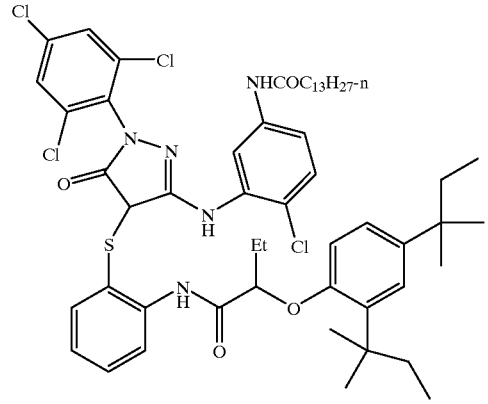

C-1

| Example[a] | | Antenna Dye | Level[b] | DL[c] | Normalized Relative Sensitivity[d] | Dye Stain[e] | Relative Dye Stain[f] |
|---|---|---|---|---|---|---|---|
| 1-1 | C | — | — | 256 | 100 | 0.028 | 100 |
| 1-2 | C | D-1 | 1.0 | 270 | 138 | 0.055 | 196 |
| 1-3 | C | D-1 | 1.5 | 268 | 131 | 0.077 | 275 |
| 1-4 | I | II-4 | 1.0 | 262 | 115 | 0.028 | 100 |
| 1-5 | I | II-4 | 1.5 | 267 | 129 | 0.028 | 100 |
| 1-6 | I | II-4 | 2.0 | 271 | 141 | 0.028 | 100 |
| 1-7 | I | II-1 | 1.5 | 267 | 129 | 0.046 | 164 |

[a]I is invention, C is comparison, [b]mol/Ag mol. [c]speed from an exposure that simulates a daylight exposure filtered to remove the blue light component. Speed measured at 0.15 above D-min. [d]1/exposure normalized relative to the comparison emulsion without an antenna dye present. [e]density of unexposed and stain processed coating. [f]relative dye stain due to dye layering multiplied by 100.

It can be seen from the results listed in Table II that the dyes of the invention afford increased photographic sensitivity relative to the case where no antenna dye is used (Example 1-1). The dyes of the invention afford less dye stain than the case where the comparison antenna dye, D-1, is used.

Photographic Evaluation

EXAMPLE 2

Film coating evaluations were carried out in color format on a sulfur-and-gold sensitized 3.18 μm×0.11 μm silver bromide tabular emulsion containing iodide (3.7 mol %). Details of the precipitation of this emulsion can be found in Fenton, et al., U.S. Pat. No. 5,476,760, incorporated herein by reference. Briefly, 3.6% KI was run after precipitation of 70% of the total silver, followed by a silver over-run to complete the precipitation. The emulsion contained 50 molar ppm of tetrapotassium hexacyanoruthenate ($K_4Ru(CN)_6$) added between 66 and 67% of the silver precipitation. The emulsion (0.0143 mole Ag) was heated to 40° C. and sodium thiocyanate (120 mg/Ag mole) was added and after a 20' hold the first sensitizing dye (dye I-4 at 0.76 mmol/Ag mol) was added. After another 20' the second sensitizing dye (dye I-5 at 0.17 mmol/Ag mol) was added. After an additional 20' a gold salt (bis(1,3,5-trimethyl-1,2,4-triazolium-3-thiolate) gold(I) tetrafluoroborate, 2.2 mg/Ag mole), sulfur agent (dicarboxymethyl-triimethyl-2-thiourea, sodium salt, 2.3 mg/Ag mole) and an antifoggant (3-(3-((methylsulfonyl)amino)-3-oxopropyl)-benzothiazolium tetrafluoroborate), 45 mg/Ag mole) were added at 5' intervals, the melt was held for 20' and then heated to 60° C. for 20'. After cooling to 40° C. 1-(3-acetamidophenyl)-5-mercaptotetrazole (compound A-2, 50 mg/Ag mole) was added. The antenna dye (see Table III for dye and level), when present was added , and then a second antenna dye (see Table III for dye and level), when present, was added to the melt. After 30' at 40° C., gelatin (647 g/Ag mole total), distilled water (sufficient to bring the final concentration to 0.11 Ag mmole/g of melt) and tetrazaindine (1.0 g/Ag mole) were added. Single-layer coatings were on acetate support. Total gelatin laydown was 3.2 g/m$^2$ (300 mg/ft$^2$). Silver laydown was 0.54 g/m$^2$ (50 mg/ft$^2$). The emulsion was combined with a coupler dispersion containing coupler C-2 instead of C-1 just prior to coating. This is a cyan dye forming coupler and would normally be used in an emulsion layer with a red sensitizing dye. To facilitate analysis in a single layer coating, green sensitizing dyes were also coated with this coupler. It is understood, however, that for traditional photographic applications the green sensitizing dyes of this invention would be used in combination with a magenta dye forming coupler. Sensitometric exposures and processing was done as in Example 1. The density of unexposed, stain-processed coatings as described in Example 1 was measured to determine the amount of dye stain as described in Example 1. Results are shown in the Table

TABLE III

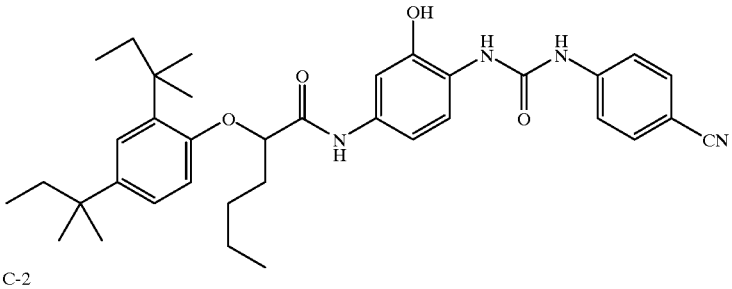

C-2

| Example[a] | | First Antenna Dye | Level[b] | Second Antenna Dye | Level[b] | DL[c] | Normalized Relative Sensitivity[d] | Dye Stain[e] | Relative Dye Stain[f] |
|---|---|---|---|---|---|---|---|---|---|
| 2-1 | C | — | — | | | 287 | 60 | 0.028 | 100 |
| 2-2 | C | D-1 | 1.0 | — | — | 309 | 100 | 0.046 | 164 |
| 2-3 | I | D-1 | 1.0 | III-3 | 0.5 | 313 | 110 | 0.044 | 157 |
| 2-4 | I | D-1 | 1.0 | III-1 | 0.5 | 312 | 107 | 0.044 | 157 |
| 2-5 | I | D-1 | 1.0 | III-7 | 0.5 | 314 | 112 | 0.046 | 164 |

[a]I is invention, C is comparison, [b]mol/Ag mol. [c]speed from an exposure that simulates a daylight exposure filtered to remove the blue light component. Speed measured at 0.15 above D-min. [d]1/exposure normalized relative to the comparison emulsion without an antenna dye D-1 present. [e]density of unexposed and stain-processed coating [f]relative dye stain due to dye layering It can be seen from the results listed in Table III that the dyes of the invention when used in combination with antenna dye D-1 afford increased photographic sensitivity without increasing dye stain relative to the case where D-1 is used alone (Example 2-2).

Photographic Evaluation

EXAMPLE 3

Film coating evaluations were carried out in color format on a sulfur-and-gold sensitized 3.7 μm×0.11 μm silver bromide tabular emulsion containing iodide (3.6 mol %). Details of the precipitation of this emulsion can be found in Fenton, et al., U.S. Pat. No. 5,476,760, incorporated herein by reference. Briefly, 3.6% KI was run after precipitation of 70% of the total silver, followed by a silver over-run to complete the precipitation. The emulsion contained 50 molar ppm of tetrapotassium hexacyanoruthenate ($K_4Ru(CN)_6$) added between 66 and 67% of the silver precipitation. The emulsion (0.0143 mole Ag) was heated to 40° C. and sodium thiocyanate (120 mg/Ag mole) was added and after a 20' hold the first sensitizing dye (dye I-4 at 0.76 mmol/Ag mol) was added. After another 20' the second sensitizing dye (dye I5 at 0.17 mmol/Ag mol) was added.. After an additional 20' a gold salt (bis(1,3,5-trimethyl-1,2,4-triazolium-3-thiolate) gold(I) tetrafluoroborate, 2.2 mg/Ag mole), sulfur agent (dicarboxymethyl-triimethyl-2-thiourea, sodium salt, 2.3 mg/Ag mole) and an antifoggant (3-(3-((methylsulfonyl)amino)-3-oxopropyl)-benzothiazolium tetrafluoroborate), 45 mg/Ag mole) were added at 5' intervals, the melt was held for 20' and then heated to 60° C. for 20'. After cooling to 40° C. 1-(3-acetamidophenyl)-5-mercaptotetrazole (compound A-2, 50 mg/Ag mole) was added. The antenna dye (see Table IV for dye and level), when present was added, and then a second antenna dye (see Table IV for dye and level), when present, was added to the melt. After 30' at 40° C., gelatin (647 g/Ag mole total), distilled water (sufficient to bring the final concentration to 0.11 Ag mmole/g of melt) and tetrazaindine (1.0 g/Ag mole) were added.

Single-layer coatings were made, exposed and processed as described in Example 2 except that emulsion was combined with a coupler dispersion containing coupler C-2 just prior to coating. The density of unexposed, stain-processed coatings was measured to determine the amount of dye stain as described in Example 1. Results are shown in the Table IV.

TABLE IV

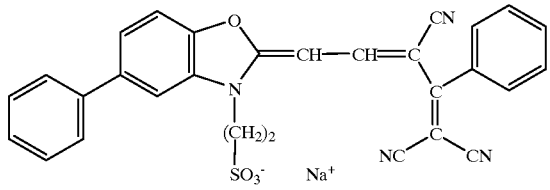

D-5

| Example[a] | | First Antenna Dye | Level[b] | Second Antenna Dye | Level[b] | DL[c] | Normalized Relative Sensitivity[d] | Relative Dye Stain[e] |
|---|---|---|---|---|---|---|---|---|
| 3-1 | — | — | — | — | — | 300 | 100 | 100 |
| 3-2 | C | D-1 | 1.0 | — | — | 309 | 123 | 166 |
| 3-3 | C | D-1 | 1.0 | D-5 | 1.0 | 320 | 158 | 190 |
| 3-4 | I | II-4 | 1.0 | D-5 | 1.0 | 317 | 148 | 134 |

[a]I is invention, C is comparison, [b]mol/Ag mol. [c]speed from an exposure that simulates a daylight exposure filtered to remove the blue light component. Speed measured at 0.15 above D-min. [d]1/exposure normalized relative to the comparison emulsion without an antenna dye D-1 present. [e]relative dye stain due to dye layering It can be seen from the results listed in Table IV that the antenna dye of the invention when used in combination with dye D-5 (example 3-4) affords increased photographic sensitivity and less dye stain relative to comparison antenna dye D-1 used alone (example 3-2). When D-1 is used in combination with D-5 (example 3-3), an unacceptable level of dye stain is obtained.

Photographic Evaluation

EXAMPLE 4

A 3.04×0.119 μm silver bromoiodide (overall iodide content 3.7) tabular grain emulsion was heated to 40° C. and sodium thiocyanate (120 mg/Ag mole) was added. Then the first sensitizing dye, I-4 at 0.76 mmol/Ag mol, was added. After another 20' the second sensitizing dye, I-5 at 0.17 mmol/Ag mol, was added. After an additional 20' a gold salt trisodium dithiosulfato gold (I) was added (2.2 mg/Ag mole) and two minutes later, sulfur agent (dicarboxymethyltriimethyl-2-thiourea, sodium salt, 2.3 mg/Ag mole) and an antifoggant (3-(3-((methylsulfonyl)amino)-3-oxopropyl)-benzothiazolium tetrafluoroborate), 45 mg/Ag mole) were added at 5' intervals. The melt was held for 2' and then heated to 65° C. for 5' and then cooled to 40 degrees. After cooling to 40° C. 1-(3-acetamidophenyl)-5-mercaptotetrazole (compound A-2, 50 mg/Ag mole) and tetrazaindine (1.0 g/Ag mole) were added were added.

At 40° C. the first antenna dye (see Table V for dye and level), when present, was added to the melt. In some cases a second antenna dye was added (see Table V for dye and level). After 30' at 40° C., gelatin (647 g/Ag mole total), distilled water (sufficient to bring the final concentration to 0.11 Ag mmole/g of melt) and tetrazaindine (1.0 g/Ag mole) were added.

Single-layer coatings were made, exposed and processed as described in Example 2 except that emulsion was combined with a coupler dispersion containing coupler C-2 just prior to coating. The density of unexposed, stain-processed coatings was measured to determine the amount of dye stain as described in Example 1. Results are shown in the Table V.

TABLE V

| Example[a] | First Antenna Dye | Level[b] | Second Antenna Dye | Level[b] | DL[c] | Normalized Relative Sensitivity[d] | Relative Dye Stain[e] |
|---|---|---|---|---|---|---|---|
| 4-1 | C — | — | — | — | 280 | 100 | 100 |
| 4-2 | C D-1 | 1.0 | — | — | 288 | 120 | 167 |
| 4-3 | C D-1 | 1.0 | D-5 | 1.0 | 300 | 158 | 222 |
| 4-4 | I II-4 | 1.0 | D-5 | 1.0 | 295 | 141 | 133 |

[a]I is invention, C is comparison, [b]mol/Ag mol. [c]speed from an exposure that simulates a daylight exposure filtered to remove the blue light component. Speed measured at 0.15 above D-min.
[d]1/exposure normalized relative to the comparison emulsion without an antenna dye D-1 present.
[e]relative dye stain due to dye layering.

It can be seen from the results listed in Table V that the antenna dye of the invention when used in combination with dye D-5 (example 4-4) affords increased photographic sensitivity and less dye stain relative to comparison antenna dye D-1 used alone (example 4-2). When D-1 is used in combination with D-5 (example 4-3), an unacceptable level of dye stain is obtained.

What is claimed is:

1. A silver halide photographic material comprising at least one silver halide emulsion comprising silver halide grains having associated therewith at least two dyes:

(a) a first dye that has at least one anionic substituent and that is capable of spectrally sensitizing a silver halide emulsion; and (b) a second dye of formula II

II

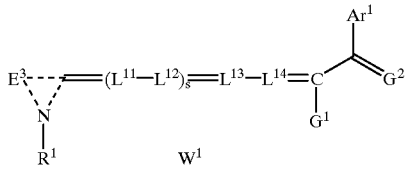

wherein:

$R^1$ is a substituted or unsubstituted alkyl or aryl group;

$E^3$ represents the atoms necessary to complete a substituted or unsubstituted 5- or 6-membered heterocyclic nucleus;

$Ar^1$ represents an electron-withdrawing substituted aryl, or a substituted or unsubstituted electron-withdrawing heteroaryl group;

$L^{11}$ through $L^{14}$ are substituted or unsubstituted methine groups;

s is 0 or 1;

$G^1$ is an electron-withdrawing group;

$G^2$ is O or dicyanovinyl ($C(CN)_2$);

$W^1$ is a counterion if necessary; and wherein at least one substituent on the dye of formula II is a cationic substituent or can be protonated to form a cationic substituent.

2. A silver halide photographic material according to claim 1, wherein the dye of formula II has a net charge of +1.

3. A silver halide photographic material according to claim 1, wherein $R^1$ of formula II does not contain an aromatic or heteroaromatic group.

4. A silver halide photographic material according to claim 1, wherein $G^1$ is cyano, s is 0, $G^2$ is ($C(CN)_2$), and $E^3$ represents the atoms necessary to complete a substituted or unsubstituted benzoxazole nucleus.

5. A silver halide photographic material according to claim 1, containing a dye of formula II wherein $Ar^1$ is a substituted aryl group having at least one substituent that has a Hammett sigma value of 0.25 or greater.

6. A silver halide photographic material according to claim 1, containing a dye of formula II wherein $Ar^1$ is a substituted aryl group wherein the sum of the Hammett sigma values of the substituent(s) is 0.40 or greater.

7. A silver halide photographic material according to claim 1, containing a dye of formula II wherein $Ar^1$ is a substituted or unsubstituted heteroaryl group having at least one nitrogen atom.

8. A silver halide photographic material according to claim 1, containing a dye of formula II wherein $Ar^1$ is a pyridyl group.

9. A silver halide photographic material according to claim 1, wherein the second dye is a dye of formula IIa.

IIa

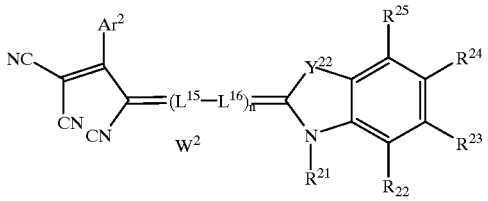

wherein:

$R^{21}$ is a substituted or unsubstituted alkyl or aryl group containing a cationic substituent;

$R^{22}$ to $R^{25}$ each individually represent hydrogen, alkyl, cycloalkyl, alkenyl, substituted or unsubstituted aryl, substituted or unsubstituted heteroaryl, substituted or unsubstituted aralkyl, alkylthio, hydroxy, hydroxylate, alkoxy, amino, alkylamino, halogen, cyano, nitro, carboxy, carboxylate, acyl, alkoxycarbonyl, aminocarbonyl, sulfonamido, sulfamoyl, including the atoms required to form fused aromatic or heteroaromatic rings;

$Ar^2$ is an electron-withdrawing substituted aryl, or a substituted or unsubstituted electron-withdrawing heteroaryl group;

$L^{15}$ and $L^{16}$ are substituted or unsubstituted methine groups;

n represents 1 or 2;

$Y^{22}$ is O, S, Te, Se, substituted or unsubstituted N, substituted or unsubstituted C=C, or substituted C;

$W^2$ is a counterion if necessary.

10. A silver halide photographic material according to claim 9 wherein $Y^{22}$ is O and n=1.

11. A silver halide photographic material according to claim 9, wherein $Y^{22}$ is O, n=1, and at least one of $R^{22}$ to $R^{25}$ is an aromatic group.

12. A silver halide photographic material according to claim 9, a wherein $Y^{22}$ is O, n=1, at least one of $R^{22}$ to $R^{25}$ is an aromatic group, and $Ar^2$ is a substituted or unsubstituted pyridyl group.

13. A silver halide photographic material according to claim 1, wherein said first dye is present at a concentration of at least 80% of monolayer coverage.

14. A silver halide photographic element according to claim 1, further comprising at least one additional dye that has at least one anionic substituent and that is capable of spectrally sensitizing a silver halide emulsion.

15. A silver halide photographic element according to claim 14, wherein the dyes that have at least one anionic substituent and that are capable of spectrally sensitizing a silver halide emulsion are present such that the total concentration of the dyes is at least 80% of monolayer coverage.

16. A silver halide photographic element according to claim 14 or claim 15, wherein the dye of formula II is present in an amount of at least 50% of monolayer coverage.

17. A silver halide photographic element according to claim 1, wherein said first dye is of formula Ia or Ib:

(Ia)

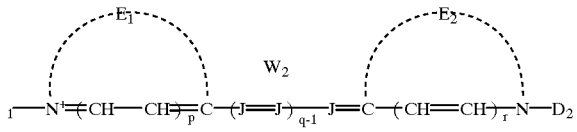

wherein:

$E_1$ and $E_2$ may be the same or different and represent the atoms necessary to from a substituted or unsubstituted heterocyclic ring which is a basic nucleus, each J independently represents a substituted or unsubstituted methine group, q is a positive integer of from 1 to 4, p and r each independently represents 0 or 1, $D_1$ and $D_2$ each independently represents substituted or unsubstituted alkyl or unsubstituted aryl and at least one of $D_1$ and $D_2$ contains an anionic substituent, $W_2$ is one or more counterions as necessary to balance the charge;

(Ib)

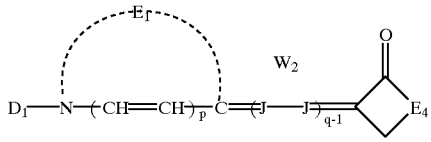

wherein:

$E_1$, $D_1$, J, p, q and $W_2$ are as defined above for formula (Ia) and $E_4$ represents the atoms necessary to complete a substituted or unsubstituted heterocyclic acidic nucleus.

* * * * *